US006113154A

United States Patent [19]

Thut

[11] Patent Number: 6,113,154

[45] Date of Patent: Sep. 5, 2000

[54] IMMERSION HEAT EXCHANGERS

[76] Inventor: Bruno H. Thut, 16755 Park Circle Dr., Chagrin Falls, Ohio 44023-4598

[21] Appl. No.: 09/153,734

[22] Filed: Sep. 15, 1998

[51] Int. Cl.[7] ..... F16L 55/00

[52] U.S. Cl. ..... 285/92; 285/114; 285/124.5; 285/911; 285/288.1; 165/905; 29/428; 29/890.031

[58] Field of Search ..... 285/61, 64, 330, 285/124.1, 124.2, 124.3, 124.4, 30, 911, FOR 118, 219, 220, 114, 124.5, 288.1; 29/428, 890.031; 165/905

[56] References Cited

U.S. PATENT DOCUMENTS

| | | | |
|---|---|---|---|
| 1,914,736 | 6/1933 | Coutu | 285/92 |
| 2,489,660 | 11/1949 | Mueller . | |
| 4,420,022 | 12/1983 | Landry | 285/330 |
| 5,165,731 | 11/1992 | Kimuta | 285/220 |
| 5,205,520 | 4/1993 | Walker | 285/61 |
| 5,593,279 | 1/1997 | Hayashi | 285/330 |

OTHER PUBLICATIONS

Four page brochure, Impervious Graphite Immersion Plate Heaters, published by American Chemical Systems Inc.

*Primary Examiner*—Dave W. Arola
*Attorney, Agent, or Firm*—Watts Hoffman Fisher & Heinke

[57] ABSTRACT

A pressurized fluid circulating assembly includes a body made of non-metallic, brittle material. At least two apertures formed by internal threads are disposed in the body. First coupling members each include a first externally threaded male portion that can engage the threads of one of the apertures, a second internally threaded female portion and a head with multiple flats. Second coupling members each have an externally threaded male portion that can engage the second threaded portion of one of the first coupling members. A movement-inhibiting member is disposed at a fixed position near at least one flat of each of two of the first coupling members to prevent their rotation. A device may employ a movement-inhibiting member having a size and shape so as to be adapted to be received at a fixed position near at least one flat of each of two of the first coupling members when threaded into engagement with the apertures, thereby preventing rotation of the first coupling members. A method includes rotating to a tightening torque the externally threaded male portions of each of the first coupling members into engagement with the threads of one of the body apertures. The movement-inhibiting member is disposed at a fixed position near at least one flat of each of two of the first coupling members. The externally threaded male portion of each of the second coupling members is threaded into the second internally threaded female portion of one of the first coupling members. Rotation of the first coupling members is prevented by engaging the at least one flat of each of the first coupling members with the movement-inhibiting member.

23 Claims, 2 Drawing Sheets

IMMERSION HEAT EXCHANGERS

FIELD OF THE INVENTION

This invention relates to immersion heat exchangers and, more specifically, to a method and apparatus for connecting fluid couplings to the immersion heat exchangers.

BACKGROUND OF THE INVENTION

Immersion plate heaters are used in the metal processing industry for heating solutions used to treat metal. For example, an immersion plate heater may be used to heat an acidic pickling bath used to remove the scale from steel. Because immersion plate heaters are submerged in chemical baths, they are formed of a material that should not react adversely to the chemicals of the bath. Immersion plate heaters used in the metal processing industry are made of graphite and, while they are relatively non-reactive chemically, they fracture relatively easily and threaded openings in them are susceptible to stripping.

A pressurized heated fluid such as steam is typically circulated through the immersion plate heaters to heat the bath. Fluid couplings such as nipples are used to connect the immersion plate heaters to steam lines. The connection between the fluid line and heater must provide a good seal which withstands the internal pressure of the fluid and also resists invasion of caustic chemicals from the bath solution.

A commonly used connection method is to tap threaded apertures into the heater. Reducers are threaded into the apertures to a predetermined torque. Nipples are then each threaded at one end to the reducer and connected at the other end to the steam line. Subsequent connections or disconnections between the steam line and the heater are accomplished by removing the nipples from the reducers, thereby leaving the fragile threaded engagement between the heater and reducer undisturbed. A problem with this method of connecting the fluid lines to an immersion heater is that when the nipple is rotated so as to be threaded to the reducer, it may rotate the reducer as well. The additional rotation causes an excessive torque to be applied to the threads in the fragile heater, resulting in stripping of the graphite threads, or fracturing or weakening of the graphite heater, which may cause failure once the heater is pressurized. Fractures in the immersion plate heater are particularly hazardous because failure after connection and submersion may subject an operator to pressurized spray of fluid and acidic pickling solution. Another problem is that the reducers, nipples and fluid line may be dislodged from the heat exchanger under pressure, which subjects workers to the risk of injury from these components.

An object of the present invention is to provide an improved method and apparatus for connecting fluid lines to a graphite immersion heat exchanger which prevents overtightening of reducers in the threaded aperture openings and resulting damage to the heat exchanger. Use of the present invention results in significant safety improvements, as well as increased life and performance of the heat exchanger.

SUMMARY OF THE INVENTION

The present invention is generally directed to strengthening connections for a pressurized fluid circulating body to prevent overtorquing of first coupling members (e.g., reducers) that are threaded to apertures in the body. A movement-inhibiting member is disposed at a fixed position near at least one flat of each of two of the first coupling members to prevent their rotation when second coupling members (e.g., nipples), which lead to pressurized fluid (e.g., steam or water) lines, are threaded to the first coupling members. The present invention prevents the first coupling members from being overtorqued, thereby avoiding the problem of breakage of the body and injury to workers due to ejected couplings and the unexpected release of pressurized fluid.

One aspect of the present invention is directed to a pressurized fluid circulating assembly comprising a body made of non-metallic, brittle material (e.g., a graphite immersible heat exchanger). At least two apertures formed by internal threads are disposed in the body. The first coupling members (e.g., reducers) each include a first externally threaded male portion that can engage the threads that form one of the apertures, a second internally threaded female portion and a head with multiple (e.g., six) flats. Second coupling members (e.g., nipples) each have an externally threaded male portion that can engage the second threaded female portion of one of the first coupling members. A movement-inhibiting member is disposed at a fixed position near at least one flat of each of two of the first coupling members to prevent their rotation.

In particular, the movement-inhibiting member may be in the form of a plate at least a portion of which is disposed near at least one flat of each of adjacent first coupling members. A rectangular plate disposed between adjacent first coupling members is preferred. The plate is preferably welded to one flat of each of adjacent first coupling members. Thread locking means (e.g., adhesive and/or sealing tape) may also be used for locking the threads of the first coupling members in the threads that form the apertures.

Another aspect of the invention is a device for strengthening connections to a pressurized fluid circulating assembly. The device comprises the movement-inhibiting member having a size and shape so as to be adapted to be received at a fixed position near at least one flat of each of two of the first coupling members when the first coupling members are threaded into engagement with the threads that form the apertures in the heat exchanger body. This prevents rotation of the adjacent first coupling members when the second coupling members are threaded into engagement with them. More particularly, the movement-inhibiting member used in the device is a plate having a size and shape that enables positioning near at least one flat of each of adjacent first coupling members. The size and shape enable the plate to be disposed at a position that enables welding to the flats. The device may also include the thread locking means for locking the threads of the first coupling member to the threads that form the apertures.

The use of the movement inhibiting member offers several advantages. It provides a simple yet effective way to prevent the first coupling members from being turned by rotation of the second coupling members. A graphite immersion heater in which the first coupling members are screwed and cemented to the body and having a rectangular movement-inhibiting plate welded between adjacent first coupling members has lasted for several months with no problems with the connections while operating the heater at a hydrostatic pressure of 150 psi. Immersion heaters are typically not operated at a hydrostatic pressure above 75 psi. Moreover, a typical immersion heater in which the reducers have been overtorqued can fail soon after. In contrast, overtorquing is prevented in the present invention. This results in a significant improvement in safety as the couplings remain fixed to the heat exchanger and unwanted fluid discharge from the fluid lines is prevented.

A method of connecting couplings to a pressurized fluid circulating body made of nonmetallic, brittle material, comprises the steps of:

(a) rotating to a tightening torque the externally threaded male portion of each of the first coupling members into engagement with the threads that form one of the body apertures;

(b) disposing the movement-inhibiting member at a fixed position near at least one flat of the multiple-flat head of each of two of the first coupling members;

(c) threading the externally threaded male portion of each of the second coupling members into the second internally threaded female portion of one of the first coupling members; and (d) preventing rotation of the first coupling members by engaging at least one flat of each of the coupling members with the movement-inhibiting member.

In particular, the apertures may be formed by retapping over old apertures before the step (a) as in the case of retrofitting used heat exchangers. The threads of the male portions of the first coupling members may be fixed to the threads that form the apertures, such as by applying adhesive between the threads of such male portions and the threads that form the apertures, or by wrapping sealing tape around the threads of such male portions. The movement-inhibiting member may be disposed at a fixed position near at least one flat of a six flat head of each of adjacent first coupling members. The movement-inhibiting members are preferably welded to the heads of adjacent first coupling members.

Other objects and advantages and a fuller understanding of the invention will be had from the accompanying drawings and the detailed description of preferred embodiments that follows.

DETAILED DESCRIPTION OF PREFERRED EMBODIMENTS

Figure 1:
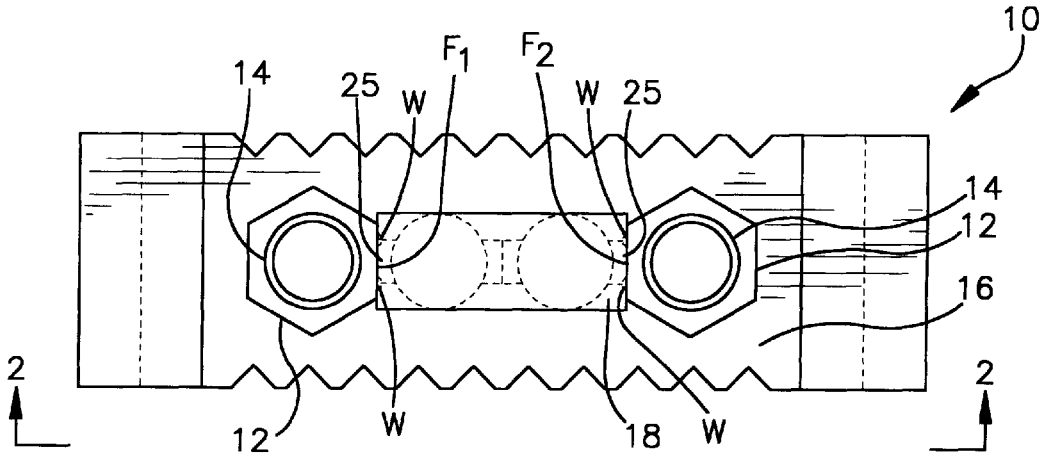
FIG. 1 is a top plan view of an immersion plate heat exchanger having fluid couplings installed according to the present invention.
Figure 2:
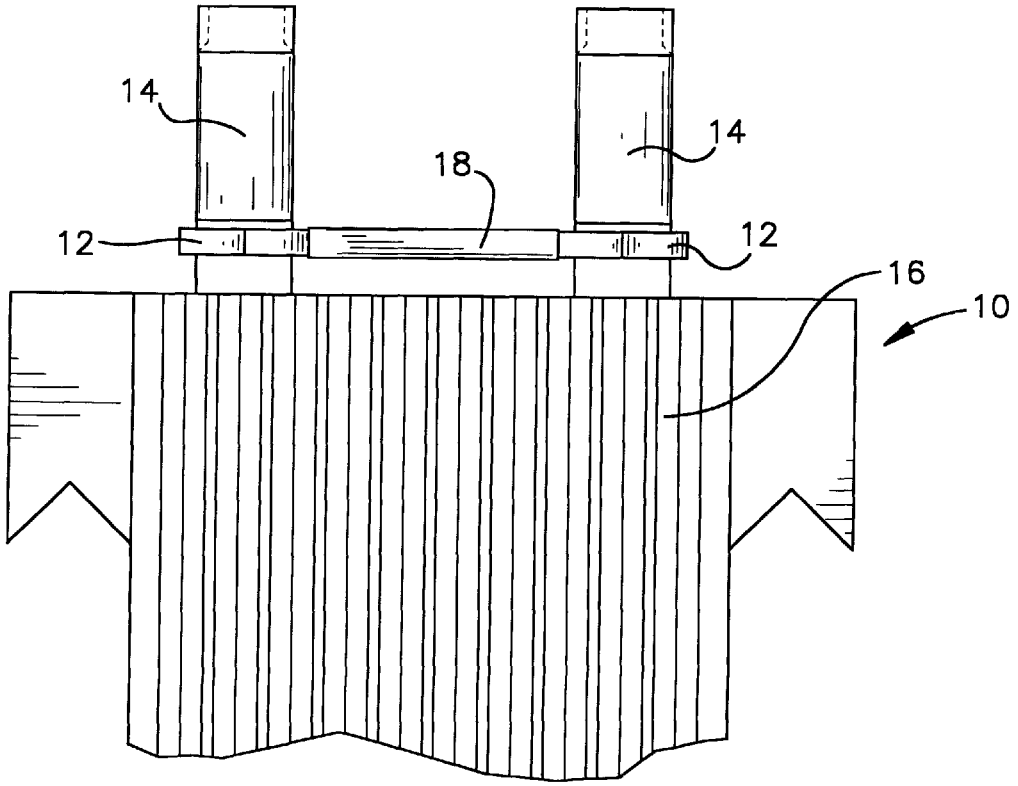
FIG. 2 is a front elevational view of the immersion plate heat exchanger of FIG. 1.
Figure 3:
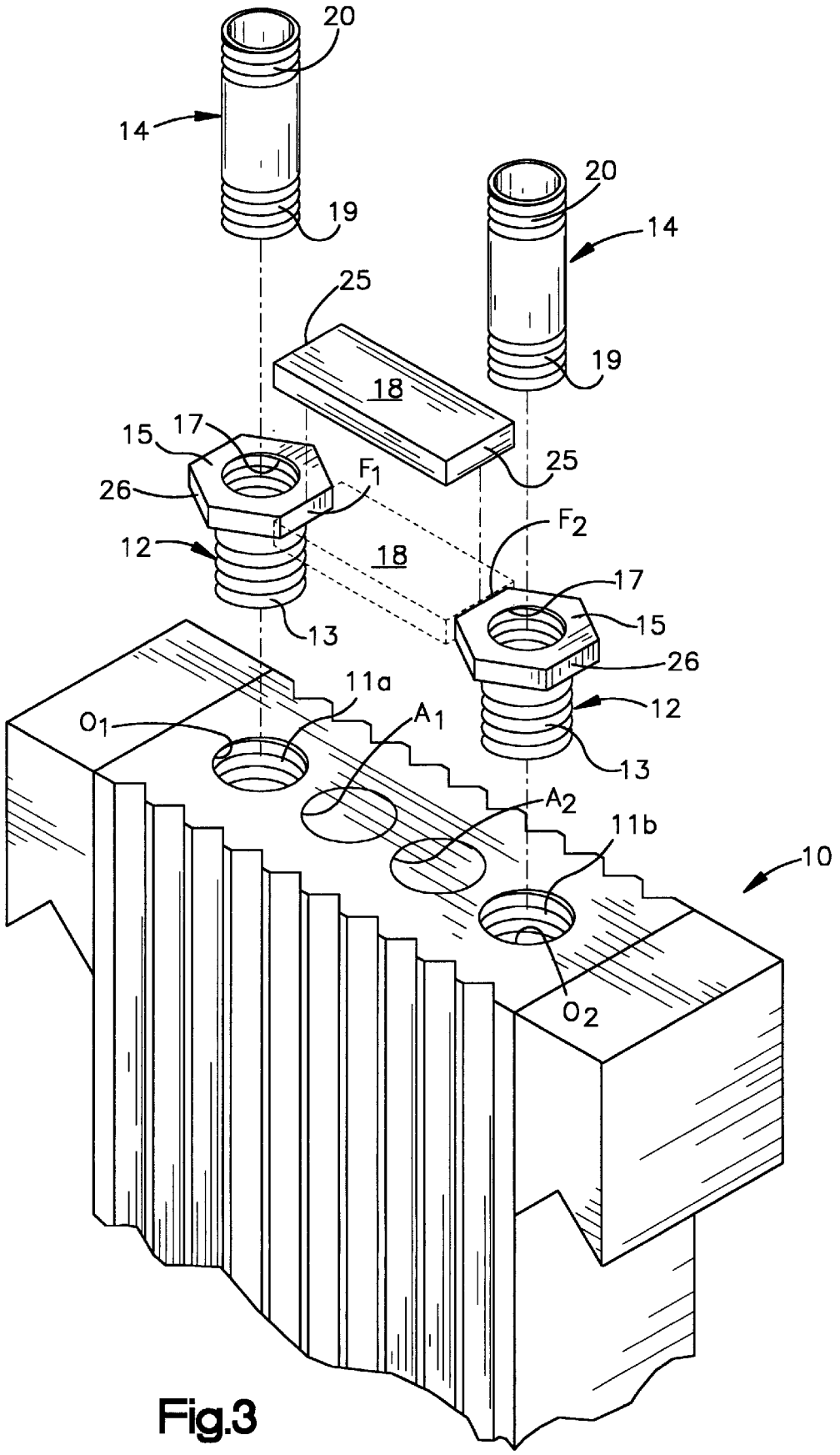
FIG. 3 is an exploded view of the immersion plate heat exchanger of FIG. 2.

Referring now to the drawings, FIGS. 1–3 show an immersion plate heat exchanger 10 having a body 16 that can be suspended in a tank on horizontal supports. Although the body is preferably formed of graphite, other body materials may also be suitable, such as ceramic materials. Inlet and outlet openings $O_1$, $O_2$ formed in the body are tapped to form internally threaded inlet and outlet apertures 11*a* and 11*b*. Second couplings or nipples 14 are to be installed on the body. Each of the couplings 14 has a preferably externally threaded fluid line portion 20 and an externally threaded male end portion 19. The couplings 14 are threaded at the portions 20 to threaded connections of fluid lines so that the fluid enters the body through inlet aperture 11*a* and exits the body through outlet aperture 11*b*.

The fluid circulates through the heat exchanger body 16 through a passageway extending in zig-zag fashion among the inlet opening $O_1$, apertures $A_1$ and $A_2$ (later plugged as shown) and the exit aperture $O_2$. The heat exchanger is immersed in treating solution up to a level below the top of the body (not shown). Typical treating solutions are, for example, a pickling acid solution (e.g., nitric or hydrofluoric acid), a plating solution, or the like. Heat transferring fluids suitable for use in the heat exchanger body of the invention are water at, for example 50–60 psi, and steam at, for example 75–150 psi. The steam is used for heating the treating solution by transferring heat from the steam through the heat exchanger body into the treating solution, while the water is used for cooling the treating solution by transferring heat from the treating solution through the heat exchanger body and to the water. The apertures 11*a*, 11*b* may be apertures resulting from retapping of old apertures as part of a retrofit operation or they may be used as originally manufactured (i.e., the apertures originally tapped in a newly fabricated immersion heat exchanger).

A first coupling member in the form of a hexagonal- or "hex-" headed reducer 12 is used in each aperture 11*a*, 11*b* to interconnect the fluid couplings 14 and the heat exchanger. The reducer 12 comprises a head 15, an externally threaded male portion 13, and an internally threaded female portion or aperture 17. Although the hex-shaped head 15 shown on each reducer 12 is preferred, any head shape which incorporates multiple flats is suitable for practicing the invention. A thread-locking means such as adhesive material or Teflon® brand sealing tape, is preferably used. The adhesive and/or sealing tape is applied between the threaded male portion 13 and the threads that form the apertures 11*a*, 11*b*. The adhesive may be applied directly to the threaded male portions 13 and the tape may be wrapped around the portions 13. A cement such as phenolic graphite cement by Union Carbide, is suitable for use as the adhesive material. The reducers 12 are then rotated by a wrench placed on at least two of the flats so that the externally threaded portions 13 engage the internal threads that form the apertures 11*a*, 11*b*. The reducers are tightened to within a desired or predetermined torque range.

A movement- (i.e., overtightening-) inhibiting plate 18 having at least two flat-engaging-surfaces 25 is secured to a location where it can be contacted by at least one flat 26 of each of at least two reducer heads 15 once the reducers are threaded to the apertures at the appropriate torque. The plate 18 may be secured to the heat exchanger using adhesive or other fastener, but is preferably secured to the reducers such as by welding to form welds W. The movement-inhibiting plate engages at least one flat 26 of each of preferably adjacent reducer heads 15 so as to prevent rotation of each of the reducers 12. It is preferred that the plate 18 be disposed between the reducers as shown so as to engage generally parallel flats $F_1$ and $F_2$ (FIG. 3). While a rectangular plate 18 is shown, any suitably shaped plate may be used to practice the invention. For example, a movement-inhibiting member may have two hexagonal-shaped openings formed in it, which correspond to the size and location of at least a portion of both of the hexagonal heads of the reducers so as to prevent rotation of the reducers. In particular, a generally circular or rectangular plate having a size that completely encompasses the reducers and has hex-shaped openings that correspond to the size and location of the hex-reducers, may be used. Although single pairs of apertures 11*a*, 11*b*, hex reducers 12 and nipples 14 are shown, any number of apertures and corresponding coupling members may be present in accordance with the present invention as long as the movement-inhibiting member extends near at least one flat of each of two hex-reducers to prevent their rotation.

The male threaded ends 19 of the nipples may now be threaded into the reducer threaded apertures 17 and rotated to the desired torque without causing any additional tightening of the reducers 12 in the apertures 11*a*, 11*b*.

As components that are suitable for use in the present invention, the heat exchangers may be Mark 3 Series™ brand graphite immersion heat exchangers, supplied by Active Chemical Systems, Inc.™ with distances between aperture centers being 6 inches, 15½ inches, 25 inches or 34½ inches, for example. In the case of 6 inch between aperture centers, the following components are suitable: the nipple may be 1½ NPT, the reducer 1½ NPT×1½ NPT and the plate dimensions ½×1½×3⅞ inches.

While preferred embodiments of the invention have been illustrated and described in detail, the present invention is not to be considered limited to the precise construction disclosed. Various adaptations, modifications and uses of the invention may occur to those skilled in the art to which the invention relates and the invention is to cover hereby all such adaptations, modifications and uses which fall within the spirit or scope of the appended claims.

What is claimed is:

1. A pressurized fluid circulating assembly comprising a body made of nonmetallic, brittle material, at least two apertures formed by internal threads disposed in the body, first coupling members each including a first externally threaded male portion that engage the threads that form one of the apertures, a second internally threaded female portion and a head with multiple flats, and second coupling members each having an externally threaded male portion that engage the second threaded portion of one of said first coupling members, and a movement-inhibiting member disposed at a fixed position near at least one flat of each of two of said first coupling members to prevent rotation of said first coupling members.

2. The assembly of claim 1 wherein said movement-inhibiting member is a plate at least a portion of which is disposed near at least one flat of each of adjacent said first coupling members.

3. The assembly of claim 2 wherein said plate is welded to adjacent said first coupling members.

4. The assembly of claim 1 comprising thread locking means for locking said threads of said first coupling members in said threads that form said apertures.

5. The assembly of claim 4 wherein said thread locking means comprises adhesive material.

6. The assembly of claim 4 wherein said thread locking means comprises sealing tape.

7. The assembly of claim 1 wherein said first coupling members are in the form of reducers.

8. The assembly of claim 1 wherein six flats are disposed on said heads of said first coupling members.

9. The assembly of claim 1 wherein said body is an immersible pressurized heat exchanger.

10. The assembly of claim 9 wherein said heat exchanger is formed of graphite.

11. A device for strengthening connections to a pressurized fluid circulating assembly, the assembly including a body made of non-metallic, brittle material, at least two apertures formed by internal threads disposed in the body, first coupling members each including a first externally threaded male portion engaging the threads that form one of the apertures, a second internally threaded female portion and a head with multiple flats, and second coupling members each having an externally threaded male portion engaging the second threaded portion of one of said first coupling members, said device comprising a movement-inhibiting member having a size and shape adapted to be received at a fixed position near at least one flat of each of two of said first coupling members when said first coupling members are threaded into engagement with said apertures, thereby preventing rotation of said first coupling members.

12. The device of claim 11 wherein said movement-inhibiting member is a plate having a size and shape that enables positioning near at least one flat of each of adjacent said first coupling members.

13. The device of claim 12 wherein said size and shape enable said plate to be disposed at a position that enables welding to said flats.

14. The device of claim 11 comprising thread locking means for locking said threads of said first coupling members to said threads that form said apertures.

15. The device of claim 14 wherein said thread locking means comprises adhesive material.

16. The device of claim 14 wherein said thread locking means comprises sealing tape.

17. A method of connecting couplings to a pressurized fluid circulating body made of nonmetallic, brittle material, at least two apertures formed by internal threads disposed in the body, comprising the steps of:

(a) rotating to a tightening torque an externally threaded male portion of each of first coupling members into engagement with the threads of one of said body apertures;

(b) disposing a movement-inhibiting member at a fixed position near at least one flat of a multiple-flat head of each of two of said first coupling members;

(c) threading an externally threaded male portion of each of second coupling members into a second internally threaded female portion of one of said first coupling members; and (d) preventing rotation of said first coupling members by engaging said at least one flat of each of said coupling members with said movement-inhibiting member.

18. The method of claim 17 comprising forming said apertures by retapping over old apertures before said step (a).

19. The method of claim 17 comprising fixing said threads of said male portions of said first coupling members to said threads that form said apertures.

20. The method of claim 19 wherein said step of fixing said threads of said first coupling members to said threads that form said apertures is performed by applying adhesive between the threads of said male portions of said first coupling members and the threads that form said apertures.

21. The method of claim 19 wherein said step of fixing said threads of said first coupling members to said threads that form said apertures is performed by wrapping sealing tape around the threads of said male portions of said first coupling members.

22. The method of claim 17 wherein said movement-inhibiting member is disposed at a fixed position near at least one flat of a six flat head of said first coupling members.

23. The method of claim 17 comprising welding said movement-inhibiting member to said heads of said first coupling members.

* * * * *